US006076874A

United States Patent [19]

Lovette

[11] Patent Number: 6,076,874

[45] Date of Patent: Jun. 20, 2000

[54] BOTTLE CARRIER APPARATUS

[76] Inventor: James K. Lovette, 1876 Mission Hill Rd., Wesson, Miss. 39191

[21] Appl. No.: 09/336,130

[22] Filed: Jun. 18, 1999

Related U.S. Application Data

[63] Continuation-in-part of application No. 09/086,859, May 2, 1998, Pat. No. 5,938,256.

[51] Int. Cl.[7] ..... B65D 23/10; B65D 71/00

[52] U.S. Cl. ..... 294/87.2; 294/31.2; 294/150; 294/159; 294/170

[58] Field of Search ..... 294/137, 149, 294/150, 153, 154, 159, 164, 165, 170, 31.2, 87.2; 215/396; 206/150, 151

[56] References Cited

U.S. PATENT DOCUMENTS

| | | | |
|---|---|---|---|
| 2,611,639 | 9/1952 | Sadeck . | |
| 2,809,861 | 10/1957 | Socke . | |
| 2,970,729 | 2/1961 | Allen | 294/149 |
| 3,768,711 | 10/1973 | Wilkinson | 294/150 |
| 4,325,503 | 4/1982 | Swinney . | |
| 4,678,221 | 7/1987 | Josenhans | 294/170 |
| 5,603,545 | 2/1997 | Benson et al. | 294/150 |
| 5,695,232 | 12/1997 | Tipp . | |

*Primary Examiner*—Dean J. Kramer

[57] ABSTRACT

A bottle carrier apparatus includes an elongated, flexible web member having a central handle portion, a pair of loop portions extending oppositely and longitudinally with respect to the central handle portion, and a pair of rider members adapted for relative slidable loop forming movement on each of the loop portions, respectively. The rider members extend oppositely and longitudinally from the distal ends of the loop portions, respectively. At least one of the rider members includes a loop portion reception channel and is connected to the distal end of a corresponding loop portion to define a hinge location such that the rider member is adapted to rotate flexurally relative to its corresponding loop portion and the latter is adapted to be at least partially drawn through its corresponding loop reception channel to form an enlarged loop defined by the rider member being slidingly movable along the loop portion.

9 Claims, 8 Drawing Sheets

FIG 3
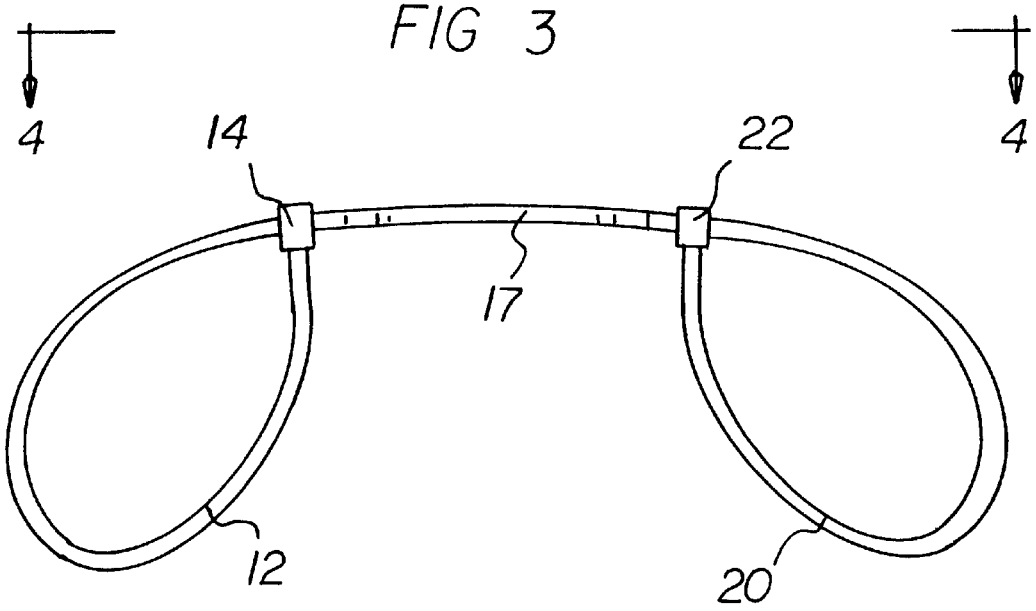
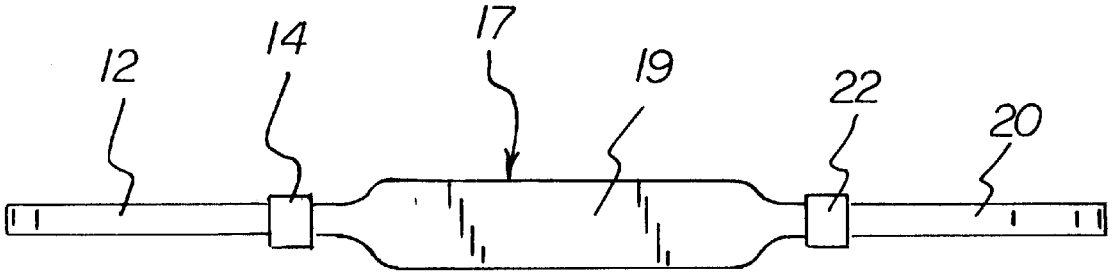
FIG 4

FIG 5
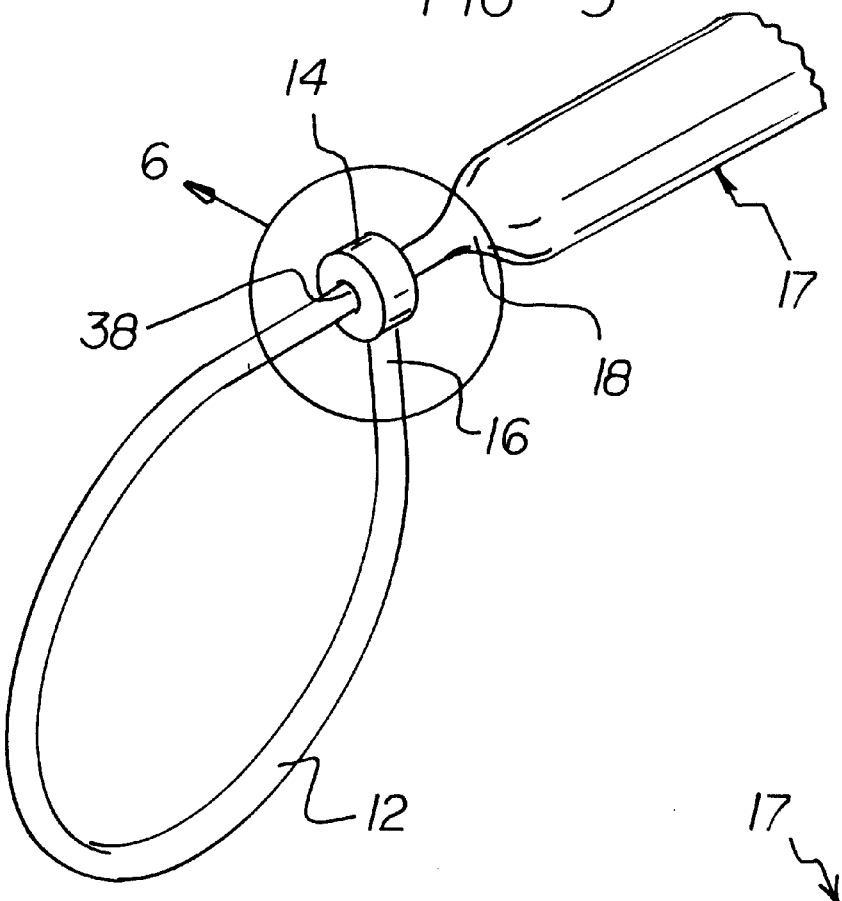
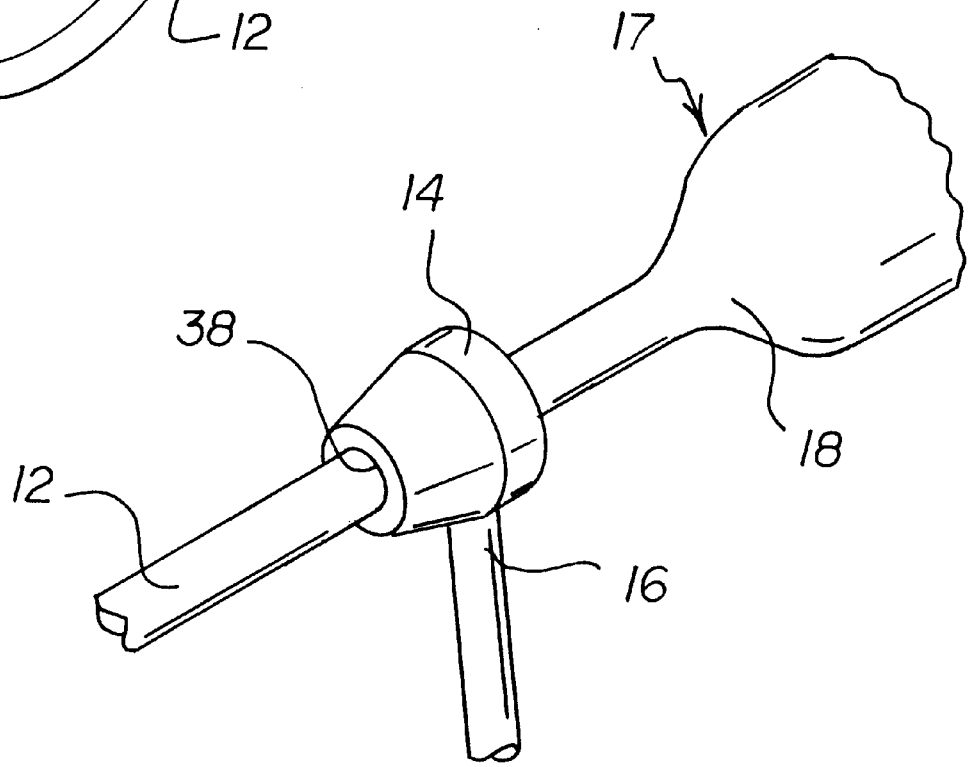
FIG 6

FIG 7
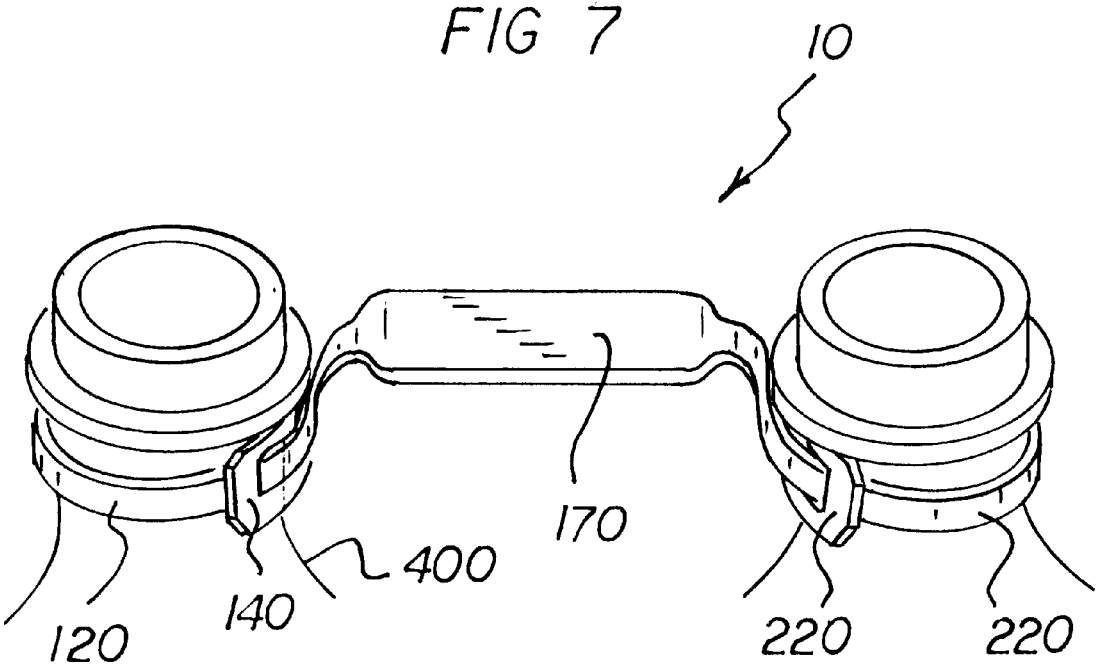
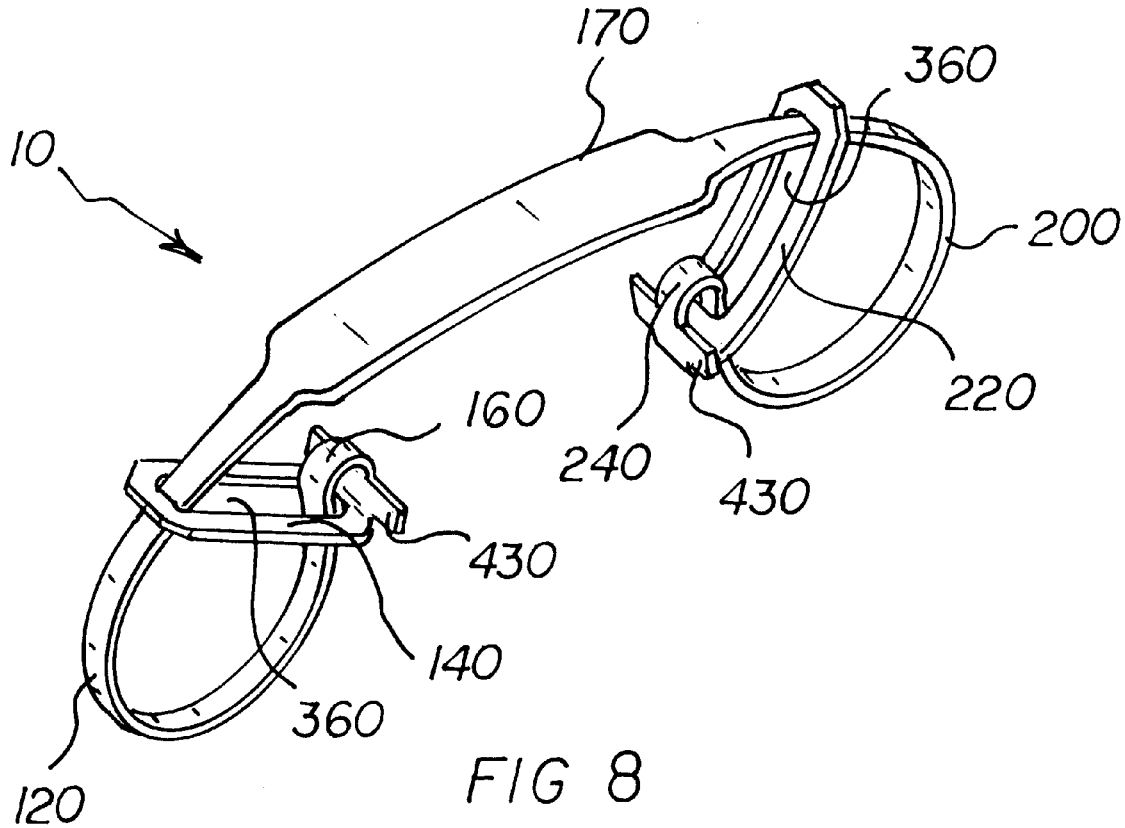
FIG 8

FIG 11
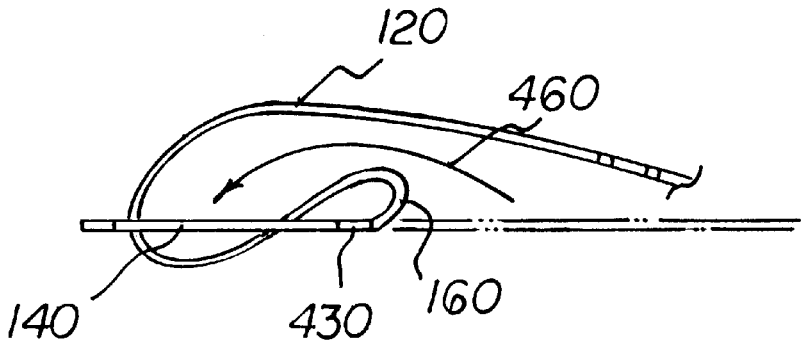
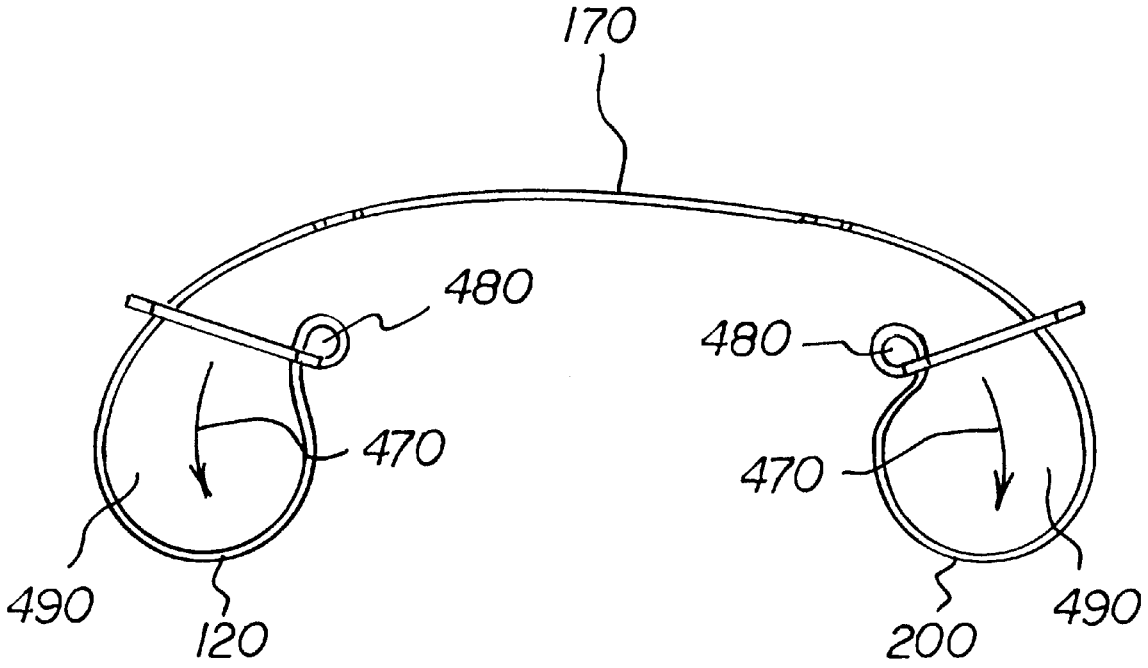
FIG 12

FIG 15
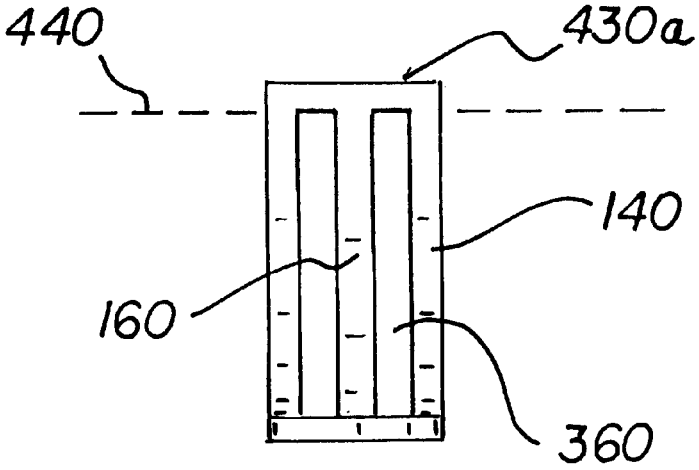
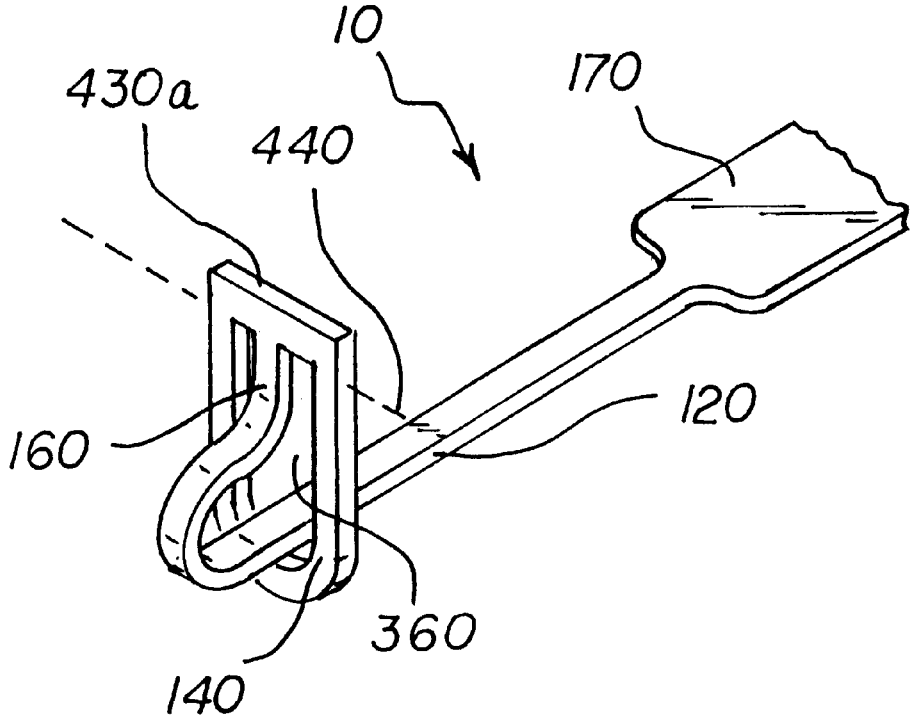
FIG 16

BOTTLE CARRIER APPARATUS

RELATED APPLICATION

This application is a continuation-in-part of prior application, Ser. No. 09/086,859, filed May 2, 1998 now U.S. Pat. No. 5,938,256.

BACKGROUND OF THE INVENTION

1. Field of the Invention

The present invention relates generally to carriers and, more particularly, to carriers especially adapted for carrying two bottles at a time.

2. Description of the Prior Art

Because of the bulky shape of bottles, handles are often attached to bottles to facilitate carrying them. Moreover, it is often desirable to carry two bottles at a time in one hand. In this respect, throughout the years, a number of innovations have been developed relating to handles for carrying two bottles at a time, and the following U.S. patents are representative of some of those innovations: U.S. Pat. Nos. 2,611,639, 2,809,861, 4,678,221, and 5,695,232. More specifically, each of U.S. Pat. Nos. 2,611,639 and 2,809,861 discloses a respective device for carrying two milk bottles or cartons. Each of these devices includes two stiff loops which have predetermined internal diameters. Because the neck portions of different bottles have different sizes, it would be desirable if a bottle carrier were provided which had flexible loops for adapting to a variety of bottle neck sizes.

U.S. Pat. No. 4,678,221 discloses a bottle carrier for two bottles which includes a single flexible loop a portion of which is threaded through a rigid hollow handle. With this device, no provision is made for locking the loop onto each bottle to secure each bottle to the loop. To prevent a bottle from dropping away from a bottle carrying loop, it would be desirable if a bottle carrier were provided which includes a locking device for locking each bottle to a carrying loop.

U.S. Pat. No. 5,695,232 a carrier for a pair of bottles wherein the carrier includes apertures for receiving the tops of two bottles and which includes two handle portions which are placed in registration which each other when a person's hand is used for carrying the bottles. To simplify the carrying of two bottles, it would be desirable if a bottle carrier were provided which does not require two handle portions to be placed in registration for two bottles to be carried.

In addition, U.S. Pat. No. 2,809,861 may be of interest for its disclosure of a can holder that includes a rigid frame and flexible straps.

Still other features would be desirable in a bottle carrier device. For example, it would be desirable if advertising matter could be printed on the handle portion of the bottle carrier device. Although plastic loops for carrying bottles can be made of relatively thin plastic, a handle portion of a bottle carrier apparatus should preferably be wider than the loops for greater comfort for the person grasping the handle portion.

In grocery stores, when bottles are placed in plastic bags, the bottles often tear the plastic bags. To prevent such an occurrence, it would be desirable if a bottle carrier were provided which enables two bottles to be carried without using a plastic bag.

Thus, while the foregoing body of prior art indicates it to be well known to use a bottle carrier for carrying two bottles at a time, the prior art described above does not teach or suggest a bottle carrier apparatus which has the following combination of desirable features: (1) has flexible loops for adapting to a variety of bottle neck sizes; (2) includes a friction-dependent locking device for locking each bottle to a carrying loop; (3) does not require two handle portions to be placed in registration for two bottles to be carried; (4) has a handle between two flexible carrying loops which is as flexible, or is more or less flexible, than the two carrying loops; (5) has advertising matter printed on the handle portion; (6) enables two bottles to be carried without using a plastic bag; and (7) has a handle portion which is wider than the carrying loops for greater comfort for the person grasping the handle portion. The foregoing desired characteristics are provided by the unique bottle carrier apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a bottle carrier apparatus which includes a first adjustable flexible loop assembly which includes a first loop portion and a first rider member connected to a translatable end of the first loop portion. A handle portion is connected at a first handle end to the first loop portion. A second adjustable flexible loop assembly includes a second loop portion connected to a second handle end of the handle portion. A second rider member is connected to a translatable end of the second loop portion. The first and second rider members each has a loop reception channel. The first loop portion and the second loop portion have a loop width. The handle portion has a handle width, and the handle width is greater than the loop width. The width of the loop reception channel in each rider member is slightly larger than the width of each loop portion. The thickness of the handle, the first and second loop portions, and the first and second rider members is substantially the same thereby forming a longitudinal bottle carrier apparatus having a substantially constant thickness throughout its longitudinal extent. To use the apparatus, the bottle carrier apparatus is manipulated to form a pair of adjustable loops at each opposed end, respectively. To form each such adjustable loop, each loop portion is folded slightly about itself to form a folded portion. The folded portion then is threaded through the loop reception channel in each rider member. The loop portion next is pulled further through the loop reception channel to cause the rider member to slide back toward the handle portion thereby creating a suitable enlarged adjustable opening or loop for emplacement about the neck of a bottle to be carried. Lifting of the handle cause the adjustable opening to decrease in diameter as the handle portion pulls the first and second loop portions through their respective rider members thereby securely and tightly engaging each bottle neck.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottle carrier apparatus which has all of the advantages of the prior art and none of the disadvantages.

It is another object of the present invention to provide a new and improved bottle carrier apparatus which may be easily and efficiently manufactured and marketed.

It is a further object of the present invention to provide a new and improved bottle carrier apparatus which is of durable and reliable construction.

An even further object of the present invention is to provide a new and improved bottle carrier apparatus which is susceptible of a low cost of manufacture with regard to both materials and labor, and which accordingly is then susceptible of low prices of sale to the consuming public, thereby making such bottle carrier apparatus available to the buying public.

Still yet a further object of the present invention is to provide a new and improved bottle carrier apparatus which has flexble loops for adapting to a variety of bottle neck sizes.

Still another object of the present invention is to provide a new and improved bottle carrier apparatus that includes a device for locking each bottle to an adjustable carrying loop.

Yet another object of the present invention is to provide a new and improved bottle carrier apparatus which does not require two handle portions to be placed in registration for two bottles to be carried.

Even another object of the present invention is to provide a new and improved bottle carrier apparatus that has a handle between two flexible carrying loops which is as flexible as the two carrying loops.

An even further object of the present invention is to provide a new and improved bottle carrier apparatus which has advertising matter printed on the handle portion.

Yet another object of the present invention is to provide a new and improved bottle carrier apparatus that enables two bottles to be carried without using a plastic bag.

Still another object of the present invention is to provide a new and improved bottle carrier apparatus which has a handle portion which is wider than the carrying loops for greater comfort for the person grasping the handle portion.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a side view of the embodiment of the bottle carrier apparatus of FIG. 2.

FIG. 4 is a top view of the embodiment of the bottle carrier apparatus of FIG. 3 taken along line 4—4 thereof.

FIG. 5 is a perspective view of a second embodiment of the loop portion of the invention.

FIG. 6 is an enlarged perspective view of the portion of the embodiment of the invention shown in FIG. 5 contained in encircled region 6 thereof.

FIG. 7 is a perspective view showing an alternatively preferred embodiment of the bottle carrier apparatus of the invention in use with two bottles being carried by a person's hand.

FIG. 8 is a perspective view of the alternatively preferred embodiment of the bottle carrier apparatus shown in FIG. 7 removed from the two bottles and released from the person's hand.

FIG. 11 is a side view of the alternatively preferred embodiment of the bottle carrier apparatus of FIG. 9 in a partially folded operative condition.

FIG. 12 is a side view of the alternatively preferred embodiment of the bottle carrier apparatus of FIG. 9 in a more completely folded operative condition.

FIG. 15 is an end view of the alternatively preferred embodiment of the bottle carrier apparatus of FIG. 13.

FIG. 16 is a fragmentary view in perspective of a portion of the alternatively preferred embodiment of the bottle carrier apparatus of FIGS. 13–15.

DESCRIPTION OF THE PREFERRED EMBODIMENT

With reference to the drawings, a new and improved bottle carrier apparatus embodying the principles and concepts of the present invention will be described.

Figure 14:
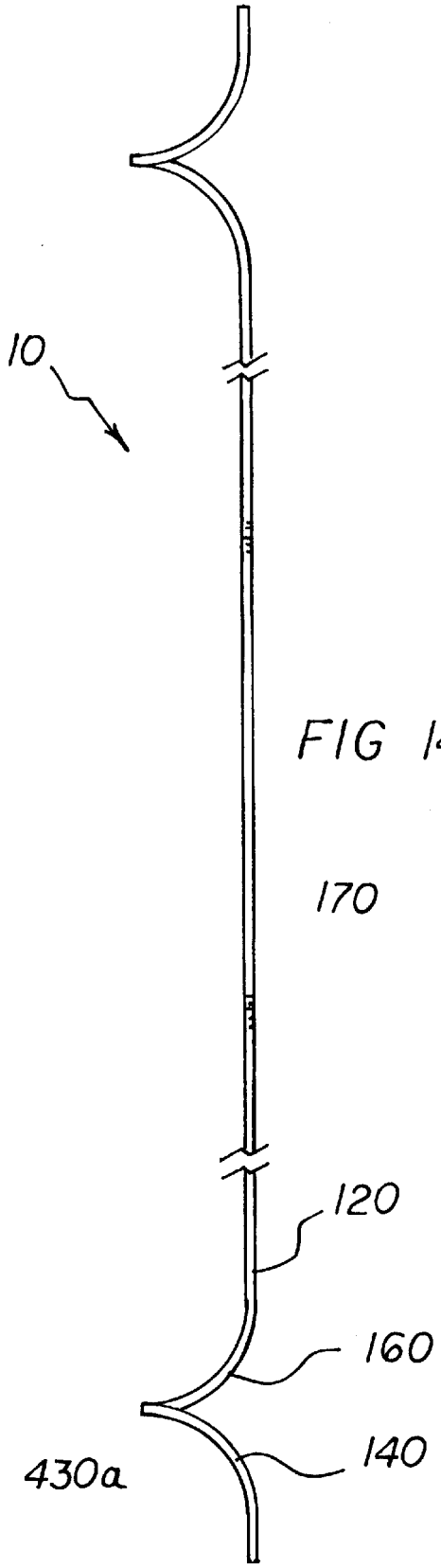
FIG. 14 is a side view of the alternatively preferred embodiment of the bottle carrier apparatus of FIG. 13.

Turning to FIGS. 14, there is shown a first embodiment of the bottle carrier apparatus of the invention generally designated by reference numeral 10. In its preferred form, bottle carrier apparatus 10 includes a first adjustable flexible loop assembly which includes a first loop portion 12 and a first rider member 14 connected to a translatable end 16 of the first loop portion 12. A handle portion 17 is connected at a first handle end 18 to the first loop portion 12. A second adjustable flexible loop assembly includes a second loop portion 20 connected to a second handle end 21 of the handle portion 17. A second rider member 22 is connected to a translatable end 24 of the second loop portion 20. The handle portion 17 may be substantially rigid or substantially flexible, i.e. the handle may be more rigid than either the first loop portion or the second loop portion, may be less rigid than either the first loop portion or the second loop portion, or may be as rigid or as flexible as the first loop portion or the second loop portion.

The first loop portion 12 and the second loop portion 20 have a loop width 26. The handle portion 17 has a handle width 28, and the handle width 28 is greater than the loop width 26. As shown in FIGS. 1–4, the first loop portion 12 and the second loop portion 20 have a rectangular cross-section, and the first rider member 14 and the second rider member 22 have a rectangular loop reception channel 36. The handle portion 17 includes a top surface 19 which includes advertising indicia.

As shown in FIGS. 5 and 6, the first loop portion 12 and the second loop portion 20 have a circular cross-section, and the first rider member 14 and the second rider member 22 have a circular loop reception channel 38.

Figure 1:
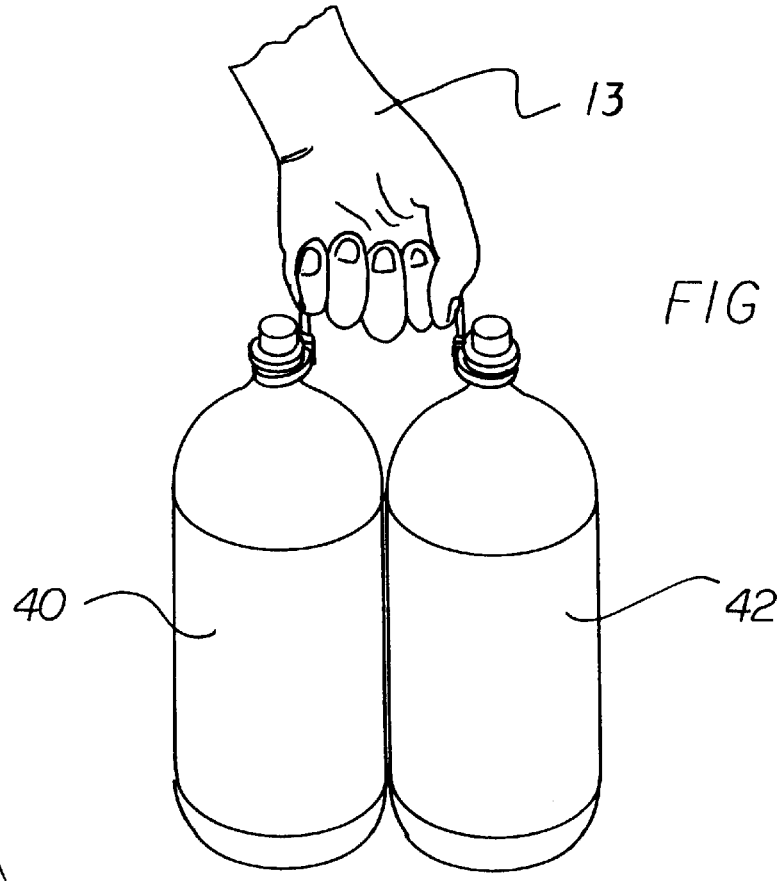
FIG. 1 is a perspective view showing a preferred embodiment of the bottle carrier apparatus of the invention in use with two bottles being carried by a person's hand.
Figure 2:
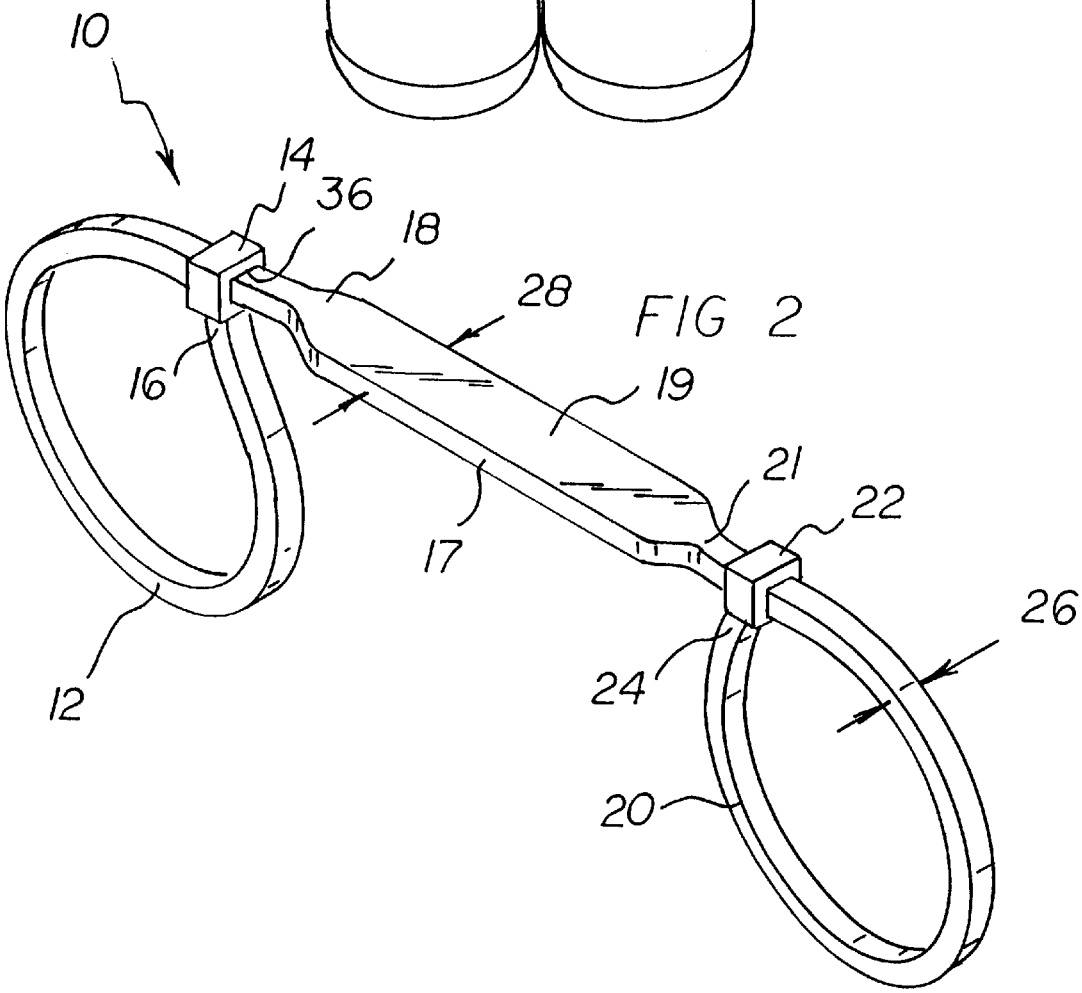
FIG. 2 is a perspective view of the embodiment of the bottle carrier apparatus shown in FIG. 1 removed from the two bottles and released from the person's hand.

To use the bottle carrier apparatus 10 of the invention, for a first bottle 40 to be carried, the first rider member 14 is slid along the first loop portion 12 so that the internal diameter of the first adjustable flexible loop assembly is larger than the outer diameter of the neck of the first bottle 40. The enlarged first adjustable flexible loop assembly is placed over the neck of the first bottle 40, and the first rider member 14 is slid along the first loop portion 12 so that the inner diameter of the first adjustable flexible loop assembly is made smaller than the neck diameter of the first bottle 40. A similar procedure is carried out for the second adjustable flexible loop assembly and the second bottle 42. When the handle portion 17 is grasped by the hand 13 of a user and lifted, the two bottles are lifted up and can be carried the user, as shown in FIG. 1.

To release the bottles, the first rider member 14 and the second rider member 22 are loosened on the first loop portion 12 and the second loop portion 20, respectively, so that the respective internal diameters of the first adjustable flexible loop assembly and the second adjustable flexible loop assembly are larger than the respective outer diameters of the necks of the bottles. Then, the adjustable flexible loop assemblies can be lifted off of the bottles.

Turning now to FIGS. 7–12 there is illustrated an alternatively preferred embodiment of the invention characterized by the bottle carrier apparatus 10 being fabricated of a thin, flat, flexible strip or web of material having a substantially constant thickness "t" along its entire longitudinal extent. Thus, referring initially to FIGS. 9 and 10, alternatively preferred bottle carrier apparatus 10 includes a first adjustable flexible loop assembly which includes a first loop portion 120 and a first rider member 140 connected to a translatable end 160 of the first loop portion 120. A handle portion 170 is connected at a first handle end 180 to the first loop portion 120. A second adjustable flexible loop assembly includes a second loop portion 200 connected to a second handle end 210 of the handle portion 170. A second rider member 220 is connected to a translatable end 240 of the second loop portion 200. Owing to the substantially constant thickness "t" of the bottle carrier apparatus along its longitudinal extent, the handle portion 170 is substantially as flexible as the first loop portion or the second loop portion for an apparatus fabricated of a given material.

Figure 9:
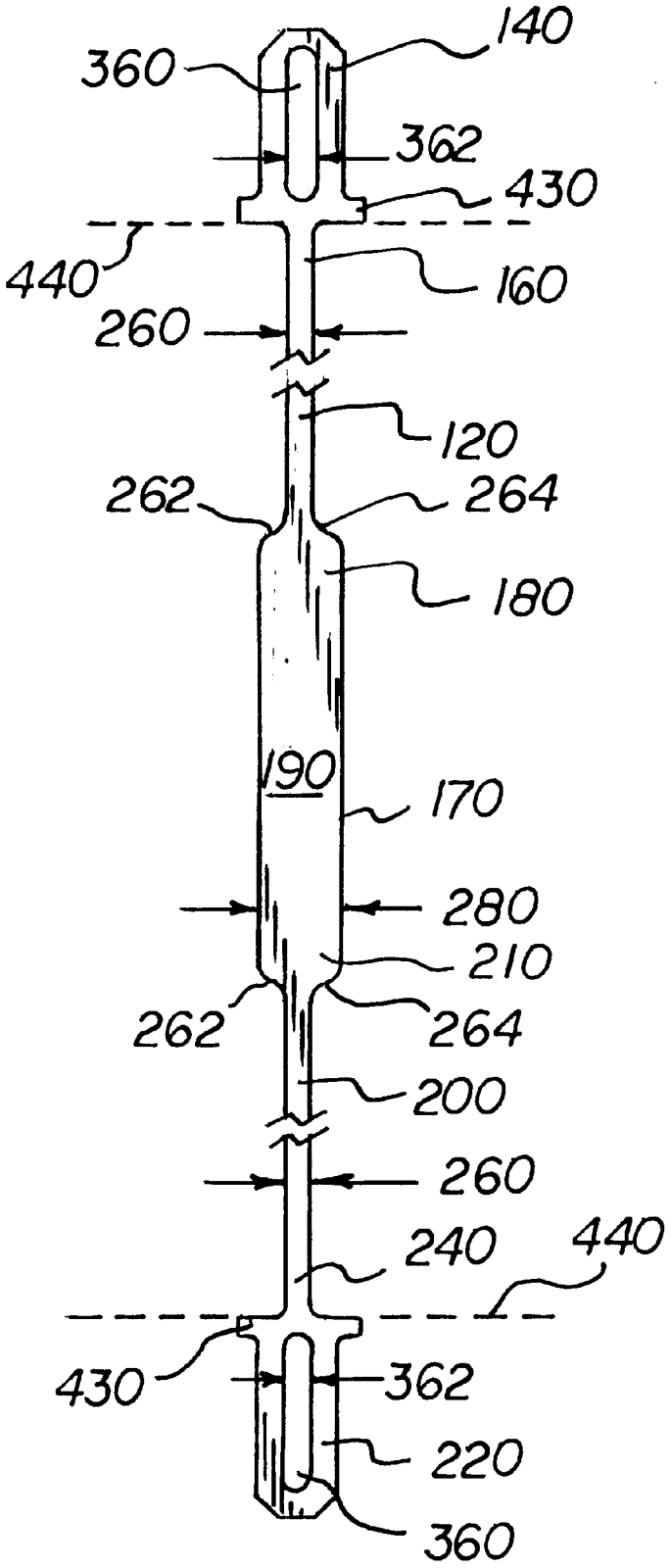
FIG. 9 is a top plan view of the alternatively preferred embodiment of the bottle carrier apparatus of FIGS. 7 and 8 in a flat unfolded condition.
Figure 10:
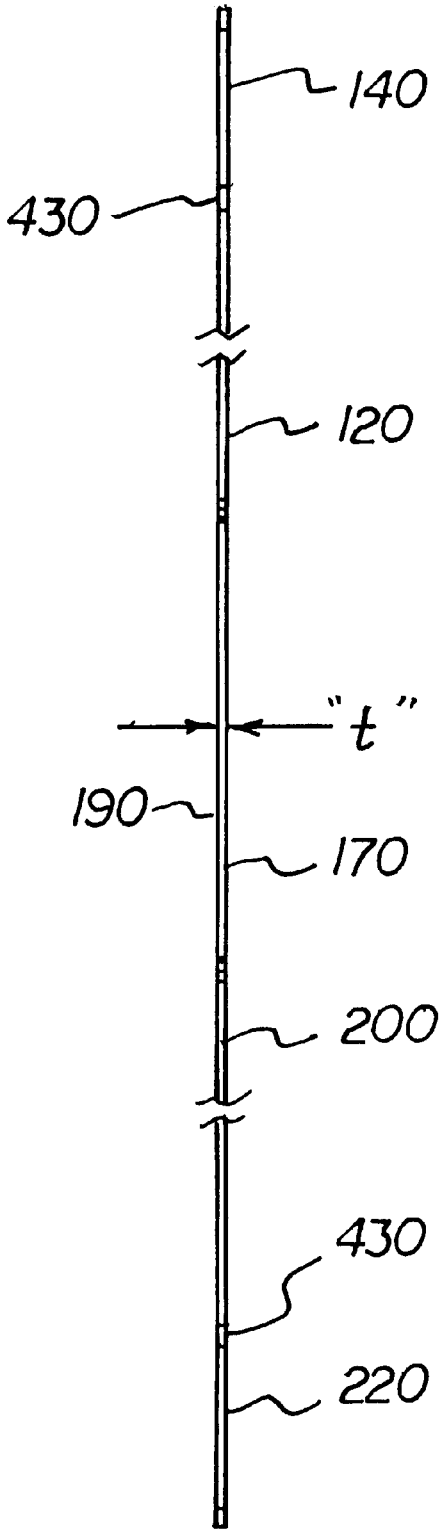
FIG. 10 is a side view of the alternatively preferred embodiment of the bottle carrier apparatus of FIG. 9.
Figure 13:
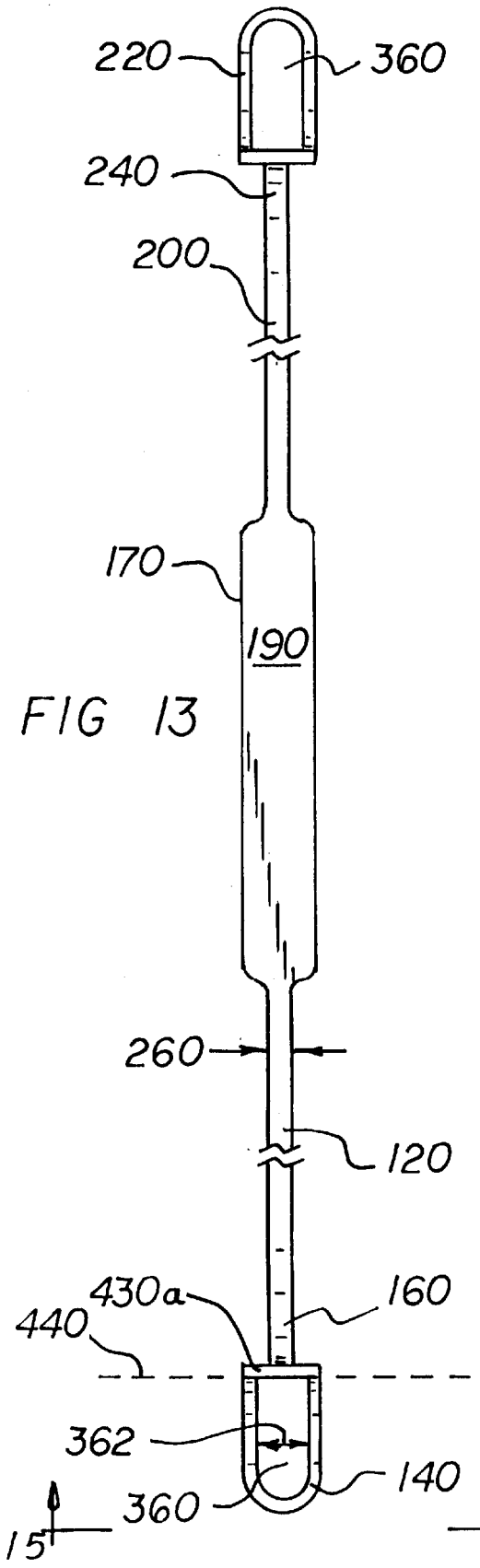
FIG. 13 is a top plan view of yet another alternatively preferred embodiment of the bottle carrier apparatus of the present invention shown.

The first loop portion 120 and the second loop portion 200 each has a loop width 260. The handle portion 170 has a handle width 280, and the handle width 280 is greater than the loop width 260. This disparity produces a pair of laterally extending abutment shoulders 262, 264 at the juncture where handle portion 170 joins first loop portion 120 and second loop portion 200, respectively. As shown in FIGS. 9 and 10, the first loop portion 120 and the second loop portion 200 each has a generally rectangular cross-section, and the first rider member 140 and the second rider member 220 each comprises a generally rectangular-shaped annular frame member through which is disposed a substantially central, oblong loop portion reception channel or opening 360. The width 362 of each loop portion reception channel 360 is sized larger than the width 260 of the first loop portion 120 and the width 260 of second loop portion 200 to permit the loop portions to pass through the loop portion reception channels as will be explained more fully below. The handle portion 170 includes a top surface 190 which, as before, may include advertising indicia or other markings.

The first rider member 140 and the second rider member 220 each has a rectangular-shaped hinge plate 430 substantially as shown, located between the proximal end of loop portion reception channel 360 and the loop end portions 160 and 240, respectively. The hinge plates 430 serve as a flexural connection member between a rider member and its corresponding loop end portion, and in turn, defines at least one lateral hinge axis 440 extending orthogonally with respect to the longitudinal axis of web 10 and the transverse axis perpendicular to the web's longitudinal axis and along which the thickness of the web "t" is measured. The purpose and advantage of hinge axis 440 will be made more apparent below.

To use the alternatively preferred embodiment of the invention, attention is directed to FIGS. 7, 8, 11 and 12. Generally speaking, and in accordance with the present invention, the flat, unfolded bottle carrier apparatus 10 is easily manipulated to form a pair of adjustable loops at each opposed end respectively. To form each such adjustable loop, the first loop portion 120 is folded slightly about itself and about hinge axis 440 to form a folded portion. The folded portion then is threaded through the oblong loop reception channel 360 in the rider member 140 as shown by arrow 460 in FIG. 11. Flexing the rider member to the right (FIG. 11) about hinge axis 440 will facilitate this action. The loop portion 120 next is pulled further through the loop reception channel 360 as schematically indicated by arrow 470 in FIG. 12 to cause the rider member to slide back toward the proximal abutment shoulders 262, 264 on the handle portion 170. This action will create a suitable enlarged adjustable opening or loop 490 (FIG. 12) ultimately for emplacement about the neck of a bottle to be carried. The adjustable loop may then be placed on the neck of the first bottle. A similar process is undertaken with respect to forming the second adjustable loop at the opposed end of the handle portion, and emplacing the second enlarged adjustable loop about the neck of a second bottle. By lifting the handle portion, the loops will automatically be reduced in diameter and thereby be tightly and securely engaged about the bottle necks, substantially as depicted in FIG. 7.

It will be appreciated that when the first or second loop portions are threaded through their respective loop reception channels, the rider members flexurally rotate about their associated hinge axes, respectively, to form a smaller loop 480 and the aforementioned enlarged adjustable loop (i.e. enlarged loop 490 in FIG. 12). As shown in FIGS. 8 and 12, the smaller loops 480 repose between their associated rider members and the underside of the handle portion when the bottle carrier apparatus is in the folded operative condition.

Alternatively, the smaller loops 480 may be dispensed with by attaching the translatable end of the loop portion directly to the underside of the hinge plate on one end of the rider member. This yet further alternatively preferred arrangement is illustrated in FIGS. 13–16. The bottle carrier apparatus of FIGS. 13–16 is especially adapted to be injection molded of a suitable flexible, yet durable plastic material such as, for example, Nylon plastic material. In its final molded form, each loop portion end (160 or 240) is attached centrally to the underside of transverse hinge plate 430*a* of each rider member to form an inverted "V" shape at opposite ends of the bottle carrier apparatus. In the embodiment of FIGS. 7–13, when the bottle carrier is not in not in use (FIGS. 9–10), the hinge axis lies in an imaginary plane extending through the handle portion, at least one rider member and its corresponding loop portion. In contrast, in the embodiment of FIGS. 13–16, the hinge axis lies outside an imaginary plane extending through the handle portion, at least one rider member and its corresponding loop portion, with the hinge axis, the proximal end of the annular member (rider member) and the distal end of the loop portion defining the "V" shape illustrated in FIG. 14 at the opposed ends of the elongated, flexible web member. It will be appreciated that in this "outside the plane" arrangement (FIG. 14), the hinge axis 430*a* coincides with the apex of the "V" shape.

The operation and use of this further alternatively preferred embodiment is similar to that of FIGS. 7–12. Thus, as schematically illustrated in FIG. 16, the loop portions may be threaded through the loop reception channels in the rider members to produce the enlarged adjustable loops for engagement with bottle necks on bottles to be carried by the apparatus of the invention.

An important advantage of the alternatively preferred embodiment(s) of FIGS. 7–16 is that the bottle carrier apparatus may be fabricated to form an essentially flat web of constant thickness thereby minimizing material cost, manufacturing cost, transportation and storage fees. The substantially flat web of FIGS. 7–12 may be die cut from a flat sheet whereas the embodiment of FIGS. 13–16 may be injection molded, both forms of manufacture permitting a wide range of suitable known plastic materials to be employed. Without limiting the present invention, an exemplary bottle carrier apparatus 10 according to FIGS. 13–16 may be injection molded from Nylon plastic material and may have the following dimensions:

| | |
|---|---|
| Length = | 12.00 inches |
| Thickness "t" = | 00.06 inches |
| Loop portion width = | 00.12 inches |
| Rider member length = | 01.00 inches |
| Rider member width = | 00.50 inches |
| Handle portion width = | 00.50 inches |
| Handle portion length = | 04.00 inches |

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved bottle carrier apparatus that is low in cost, relatively simple in design and operation, and which may advantageously be used for adapting to a variety of bottle neck sizes. With the invention, a bottle carrier apparatus is provided which includes a friction-dependent locking device for locking each bottle to a carrying loop. With the invention, a bottle carrier apparatus is provided which does not require two handle portions to be placed in registration for two bottles to be carried. With the invention, a bottle carrier apparatus is provided which has a handle between two flexible carrying loops which is as flexible, or is more or less flexible, than the two carrying loops. With the invention, a bottle carrier apparatus is provided which has advertising matter printed on the handle portion. With the invention, a bottle carrier apparatus is provided which enables two bottles to be carried without using a plastic bag. With the invention, a bottle carrier apparatus is provided which has a handle portion which is wider than the carrying loops for greater comfort for the person grasping the handle portion. With the invention, a bottler carrier apparatus is provided formed from a web of flexible durable material having a substantially constant thickness.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the abstract is neither intended to define the invention or the application, which only is measured by the claims, nor is it intended to be limiting as to the scope of the invention in any way.

What is claimed is:

1. A bottle carrier apparatus, comprising:

an elongated, flexible web member, said web member having a central handle portion, a pair of loop portions extending oppositely and longitudinally with respect to said central handle portion, and a pair of rider members adapted for relative slidable loop forming movement on each of said loop portions, respectively, wherein said rider members extend oppositely and longitudinally from the distal ends of said loop portions, respectively;

wherein at least one of said rider members includes a loop portion reception channel, said at least one rider member being connected to the distal end of a corresponding loop portion to define a hinge location such that said rider member is adapted to rotate flexurally relative to said corresponding loop portion and said corresponding loop portion is adapted to be at least partially drawn through said loop reception channel to form an enlarged loop defined by said rider member being slidingly movable along said loop portion.

2. The bottle carrier apparatus of claim 1 wherein said web member has a longitudinal first axis extending along said handle portion, loop portions and rider members, and a transverse second axis perpendicular to said longitudinal first axis, and wherein the thickness of said web measured along said transverse second axis is substantially equal all along said longitudinal first axis.

3. The bottle carrier apparatus of claim 1 wherein said rider member comprises an annular member defining a central opening, said central opening defining said loop portion reception channel, said annular member having a proximal end and a distal end, wherein said proximal end of said annular member is attached to said distal end of said loop portion to define said hinge location.

4. The bottle carrier apparatus of claim 3 wherein said hinge location defines a third hinge axis, and said third hinge axis is orthogonal to said longitudinal first axis and said transverse second axis.

5. The apparatus of claim 4 wherein said loop portion has a width measured along said hinge third axis and said central opening in said annular member is greater than said width of said loop portion.

6. The apparatus of claim 4 wherein said hinge axis lies in an imaginary plane extending through said handle portion, said at least one rider member and said corresponding loop portion.

7. The apparatus of claim 4 wherein said hinge axis lies outside an imaginary plane extending through said handle portion, said at least one rider member and said corresponding loop portion, said hinge axis, said proximal end of said annular member and said distal end of said loop portion defining a "V" shape at one end of said elongated, flexible web member, said hinge axis coinciding with the apex of said "V" shape.

8. The apparatus of claim 1 wherein said elongated flexible, web member is formed of molded Nylon plastic material.

9. The method of transporting two bottles simultaneously comprising the following steps:

(a) providing a bottle carrier apparatus as defined in claim 1, (b) rotating said one rider member flexurally relative to its corresponding loop portion, (c) drawing said loop portion partially through said loop portion reception channel to form a loop, (d) placing said loop about the neck of a first bottle, (e) repeating steps (b) through (c) with respect to the other rider member of said pair, (f) placing said other loop about the neck of a second bottle, (g) lifting said central handle portion to transport said first and second bottles simultaneously.

* * * * *